US006183288B1

(12) United States Patent
Barrat et al.

(10) Patent No.: US 6,183,288 B1
(45) Date of Patent: Feb. 6, 2001

(54) RESILIENT DEVICE ALLOWING AN ELECTRICAL CONNECTION TO BE MADE IN A CONNECTION TERMINAL

(75) Inventors: Sylvain Barrat, Belleville sur Saône; Bernard Bechaz, Caluire; Philippe France, Chazelles sur Lyon; Stéphane Prost, Arnas, all of (FR)

(73) Assignee: Entrelec S.A., Villeurbanne (FR)

( * ) Notice: Under 35 U.S.C. 154(b), the term of this patent shall be extended for 0 days.

(21) Appl. No.: 09/388,205

(22) Filed: Sep. 1, 1999

(30) Foreign Application Priority Data

Sep. 2, 1998 (FR) ..... 98 11112

(51) Int. Cl.[7] ..... H01R 4/24
(52) U.S. Cl. ..... 439/409
(58) Field of Search ..... 439/409, 391, 439/410, 387, 389, 432, 433, 434, 393, 435, 436, 834, 835

(56) References Cited

U.S. PATENT DOCUMENTS 5,127,846 7/1992 Köllmann .
5,993,244 * 11/1999 Bechaz ..... 439/417

FOREIGN PATENT DOCUMENTS 3727091 2/1989 (DE) .
295 14 509 U 10/1995 (DE) .
196 46 103 3/1998 (DE) .
197 15 971 5/1998 (DE) .
0597190 11/1996 (EP) .
0823752 2/1998 (EP) .
823752A2 * 2/1998 (EP) .
2753840 9/1997 (FR) .

* cited by examiner

*Primary Examiner*—Renee Luebke
*Assistant Examiner*—Phuongchi Nguyen
(74) *Attorney, Agent, or Firm*—Ware, Fressola, Van Der Sluys & Adolphson LLP

(57) ABSTRACT

This device is made from a flat resilient material, which has a first branch intended to bear against a fixed conducting part of a connection terminal, a moving sharply-angled second branch having, on the side of its free end, an approximately planar part provided with an opening intended for passage of the end of a cable to be connected and a part facing the first branch, as well as a linking region which joins the two branches, thus forming a loop. Each branch has a part which is concave toward the outside of the loop and the two concave parts are approximately facing each other and form a narrows inside the loop.

9 Claims, 3 Drawing Sheets

RESILIENT DEVICE ALLOWING AN ELECTRICAL CONNECTION TO BE MADE IN A CONNECTION TERMINAL

BACKGROUND OF THE INVENTION

1. Field of the Invention

The present invention relates to a resilient device allowing an electrical connection to be made in a connection terminal for electrical conductors.

2. Description of the Prior Art

It is known to use springs for maintaining the end of a stripped conductor against a current supply rail in a connection terminal. Documents DE-3,727,091 and EP-0,823,752 describe connection terminals of this type. In these documents, there is a pinching spring made from a flat resilient material shaped in a kind of loop. The pinching spring has a stop branch intended to bear on a current rail, as well as a pinching branch bent over from the back part of the pinching spring, extending transversely to the current supply rail, as well as a resilient arc joining together, via the rear, the back part and the stop branch. The pinching branch is provided with a pinching cavity. The current supply rail passes through said pinching cavity. The spring is such that, when the stripped end of an electrical conductor is inserted into the pinching cavity, the spring presses the stripped end of this wire against the current supply rail.

A device of this type can also be used for making an insulation-displacement connection for an electrical cable. In this case, the spring serves to store the energy necessary for stripping an electrical cable and to jam it in a connection slit, and then to release this energy.

Document FR 2,753,840 describes a connection terminal which includes a pinching spring and which is reduced in size in the direction transverse to the insertion of a conductor. The resilient arc of this spring is shaped in such a way that, starting from the rear part of the pinching spring, the resilient arc is placed at a position, over at least part of its arc, below a bearing plane defined by the extension of the bearing branch of the pinching spring. A cavity is then provided in the current supply rail so as to house the resilient arc of the spring.

In the known springs, the internal stresses which appear when the spring is tensioned are very high, especially in the resilient arc. For a given thickness of material, the deformation of the spring is therefore limited in order not to run the risk of damaging the spring. Consequently, one also obtains a limited tensile force exerted by the spring.

SUMMARY OF THE INVENTION

The object of the present invention is therefore to provide a resilient device allowing an electrical connection to be made in a connection terminal for electrical conductors, in which the stresses in the material are reduced when it is tensioned, so as to be able to obtain a larger tensile force. Advantageously, the resilient device according to the invention will have a reduced size in the direction transverse to the direction of insertion of an electrical cable to be connected.

For this purpose, the proposed resilient device is a device allowing an electrical connection to be made in a connection terminal for electrical conductors, made from a flat resilient material, which has a first branch intended to bear against a fixed conducting part of a connection terminal, a moving sharply-angled second branch having, on the one hand, on the side of its free end, an approximately plane part provided with an opening intended for passage of the end of a cable to be connected and, on the other hand, a part facing the first branch, as well as a linking region which joins the two branches, thus forming a loop.

According to the invention, each branch has a part which is concave toward the outside of the loop, and the two concave parts are approximately facing each other and form a narrowing inside the loop.

In this way, when the resilient device passes from its relaxed position to its stressed position, the concave parts come together until coming into contact with each other or until coming into contact with a "stop" placed at this point. During this phase, the stresses are essentially taken by the linking region. The stresses then depend on the space existing between the two branches of the device in the relaxed state. Once contact has been made, the linking region no longer deforms and the stresses are taken by the branches of the device. Thus, the stresses are distributed over a large part of the deformed structure.

The fixed conducting part against which one branch of the device bears is, for example, a current supply rail. The latter may optionally be provided with a retention slit if it is envisaged to use the resilient device according to the invention in an insulation-displacement connection terminal.

In order to increase the rigidity of the linking region, the latter advantageously also has a part which is concave toward the outside of the loop.

The narrows inside the loop has, for example, a dimension of the order of one millimeter, in the case especially where the two branches of the device are intended to come into contact with each other.

In order to optimize the distribution of stresses in the material, the device may be made from a metal blade which is thicker at its longitudinal edges than at its center. The blade used then has a cross section whose shape is reminiscent of a bone.

In the case of the use of the device according to the invention in an insulation-displacement connection terminal, the fixed first branch is also preferably sharply angled and its part lying on the side of its free end is a plane part approximately parallel to the free end part of the second branch and having an opening intended for passage of the end of an electrical cable. In this case, stripping lips are advantageously provided in the opening made in the first sharply-angled branch.

In another embodiment of the device according to the invention, a fixed core may be provided in the narrowing of the loop.

Another embodiment is such that a moving core is provided in the narrowing of the loop.

The present invention also relates to a connection device allowing an electrical cable to be connected, characterized in that it is provided with at least one resilient device as described above. This device is, for example, an insulation-displacement device.

In any case, the invention will be clearly understood with the aid of the following description which represents, by way of nonlimiting examples, three embodiments of a resilient device according to the invention.

DETAILED DESCRIPTION OF THE PRESENT INVENTION

Figure 1:
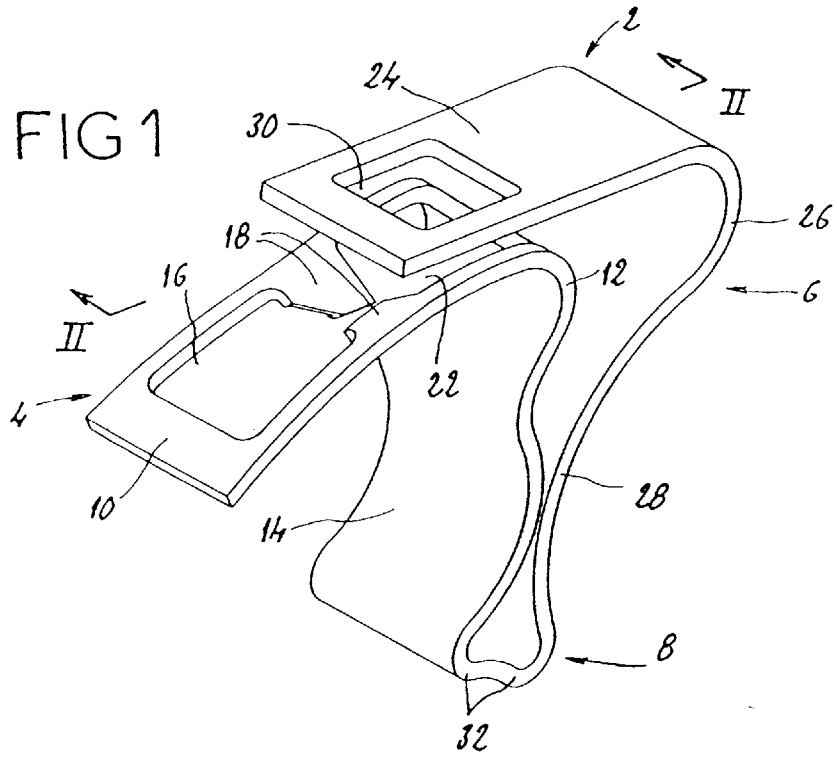
FIG. 1 is a perspective view of a first embodiment of a resilient device according to the invention.

FIG. 1 shows a resilient device 2 according to the invention. This device provides a spring function and also allows an electrical wire 100 to be stripped.

The resilient device 2 according to the invention is in the form of a loop having a fixed branch 4 and a moving branch 6. A linking region 8 joins the two branches 4 and 6, thus forming a loop. It is made from a strip of flat material, for example a strip of steel sheet.

Figure 2:
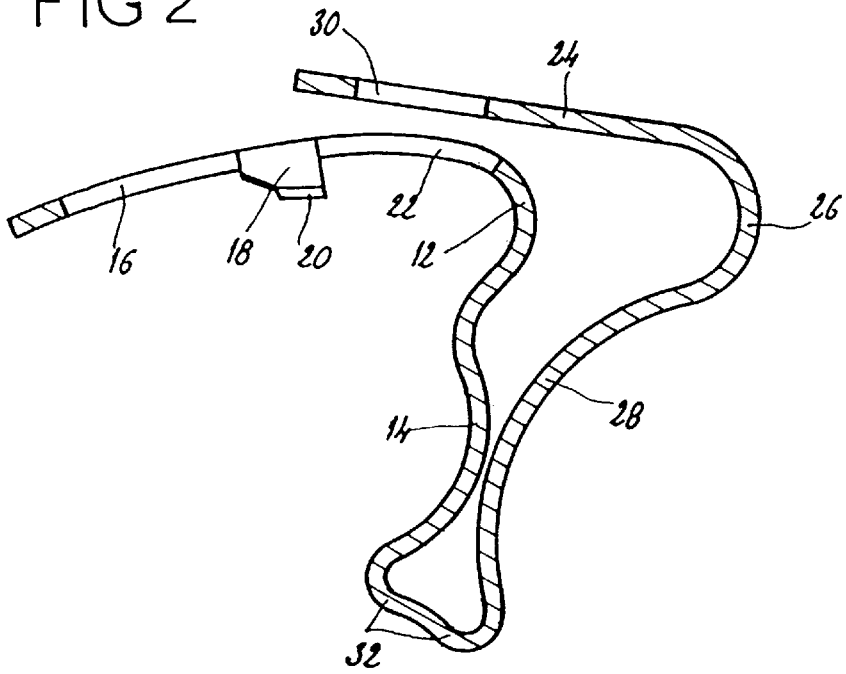
FIG. 2 is a cross-sectional view along the line II—II of FIG. 1 of the device of FIG. 1.

The fixed branch 4 is intended to bear against a fixed linking piece having a retention slit intended to house the end of a wire. This linking piece is not illustrated in the drawing. This fixed branch is illustrated on the left in FIGS. 1 and 2 while it is found on the right in FIGS. 3 to 5.

The fixed branch 4 has a sharply-angled shape. A first part 10 extends from the free end of the fixed branch 4 as far as the sharp angle 12 and a second part 14 extends from the sharp angle 12 as far as the linking region 8.

The first part is approximately planar. It has an opening 16 intended to house the end of a wire to be connected. This opening 16 is bounded on the opposite side from the free end of the fixed branch 4 by stripping lips 18. The latter are bent over downward, that is to say toward the second part 14 of the fixed branch 4. The cutting free edges 20 of the stripping lips 18 therefore lie in a plane located below the plane of the first part 10 of the fixed branch. These cutting edges face the retention slit of the linking piece against which the fixed branch 4 bears. Beyond the stripping lips 18, on the opposite side from the first opening 16, there is a second opening 22 made in the planar first part 10 of the branch 4 and intended to house the wire to be connected once the latter has been stripped and inserted into the retention slit.

The sharp angle 12 forms a bend in the fixed branch 4 of more than 90°.

The second part 14 of the fixed branch 4 is curved in such a way that it has a concave part oriented toward the outside of the loop of the resilient device. The concavity of this second part 14 therefore lies opposite the first part 10 of the fixed branch 4.

The moving branch 6 also has a sharply-angled shape. It comprises an approximately planar first part 24, a sharp angle 26 and a curved second part 28. The planar first part 24 of the moving branch 6 is intended to move approximately parallel to the first part 10 of the fixed branch 4. The movement of this first part 24 of the moving branch 6 is a translation combined with a slight rotation. It may be seen in FIG. 3 that, over the entire travel of this part 24 of the moving branch 6, a slight rotation of a few degrees is produced. This planar first part 24 of the moving branch 6 also has an opening 30. The latter is intended to guide the end of a wire to be stripped and to be connected.

The sharp angle 26 forms a bend in the moving branch 6, the angle being greater than 90°. The inside of the sharp angle 26 is intended to match the external shape of the sharp angle 12 at the end of travel, that is to say when the resilient device according to the invention is tensioned.

The second part 28 of the moving branch 6 has approximately the shape of a circular arc, the convex region of which faces the second part 14 of the fixed branch 4. In the relaxed position of the resilient device 2 according to the invention, the two branches 4 and 6 are very close together in their second parts 14 and 28, and it may be seen that the two inwardly convex parts 14 and 28 of the loop form a narrows. The width of this narrows is of the order of one millimeter.

The linking region 8 joins together the fixed branch 4 and the moving branch 6 at their second parts 14 and 28. In order to increase the rigidity of this linking region, the latter has two points of inflection 32. This linking region 8 is therefore a rigid region which hardly deforms during deformation of the resilient device 2 according to the invention.

Figure 3:
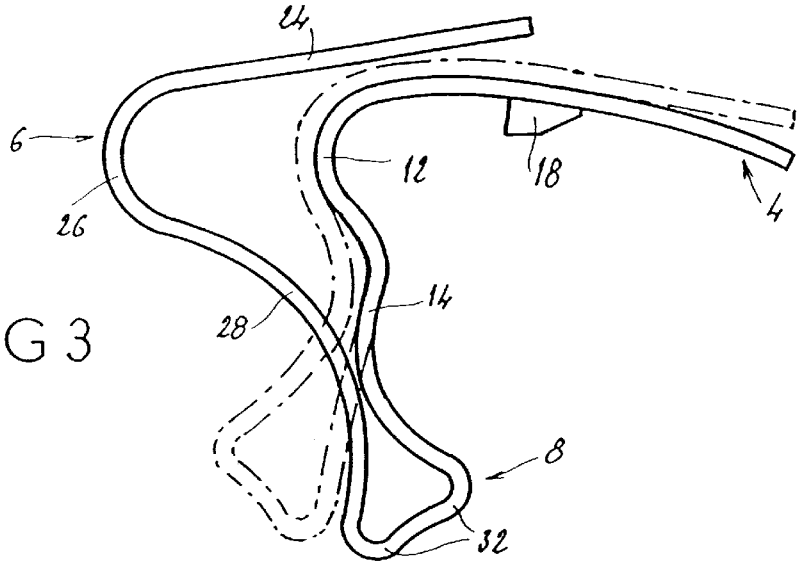
FIG. 3 is a side view showing the resilient device of FIGS. 1 and 2 in the relaxed position and in the stressed position.

FIG. 3 shows in solid lines the device described above in the relaxed state and in dot-dash lines the device in the stressed state. In order to connect an electrical wire, the resilient device 2 according to the invention is firstly brought from its relaxed position to its stressed position. It is then deformed with the aid of a tool, for example a screwdriver blade, which bears on the external part of the sharp angle 26 of the moving branch 6, exerting a force directed toward the fixed first branch 4. The moving branch 6 moves under the action of this force, causing the linking region 8 to move with it.

In a first phase, the second part 28 of the moving branch 6 comes into contact with the second part 14 of the fixed branch 4. The deformation of the resilient device 2 is therefore essentially in the linking region 8. Since the distance separating the second parts 14 and 28 of the fixed branch 4 and the moving branch 6 is small, the stresses due to this deformation in the linking region 8 are limited.

As the moving branch 6 continues to move closer to the fixed branch 4, the two curved parts 14 and 28 of these branches roll one over the other, causing, in this movement, the linking region 8 to pivot substantially about the point of contact between the fixed branch 4 and the moving branch 6. The resilient device is then deformed essentially in the region of the curved second part 14 of the fixed branch 4 and in the link between the sharp angle 26 and the curved second part 28 of the moving branch 6. The movement of the moving branch 6 continues until the sharp angle 26 of the moving branch 6 butts against the sharp angle 12 of the fixed branch 4.

When the resilient device 2 according to the invention is tensioned, as illustrated by the dot-dash lines in FIG. 3, the opening 30 made in the moving branch 6 faces the first opening 16 made in the first part 10 of the fixed branch 4. It is then possible to insert the end of a wire 100 through these two openings. If the resilient device 2 is then released, the latter has a tendency to return to its relaxed position. The moving branch 6 tends to move away from the fixed branch 4. The first part 24 of the moving branch 6 then moves with respect to the first part 10 of the fixed part 4 in a movement close to a translation parallel to these two planar parts 10 and 24. The end of the wire 100 inserted into the opening 30 is then drawn by the edge of this opening toward the second opening 22 made in the fixed branch 4. The end of the wire then passes between the stripping lips 18 before sliding into the retention slit made in the linking piece on which the fixed branch 4 bears. The wire is thus connected. The resilient device 2 according to the invention is then not completely in its relaxed position but still exerts a stress on the wire via one edge of the opening 30 in the moving branch 6 so as to guarantee good electrical contact between the core of the connected wire and the linking piece.

Figure 4:
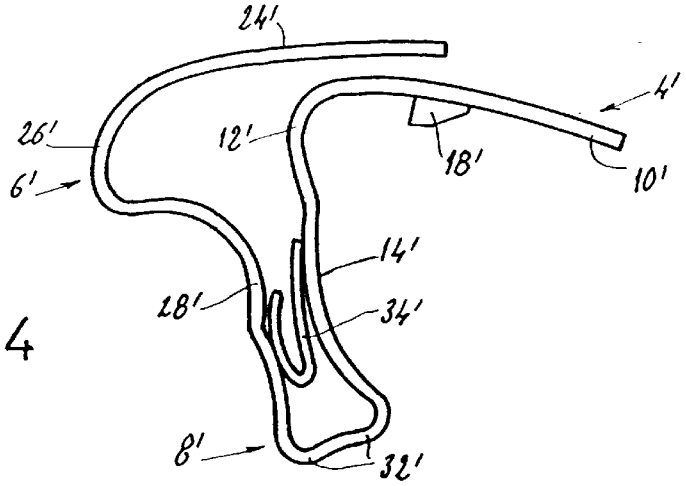
FIGS. 4 and 5 show, in side view, two alternative embodiments of a resilient device according to the invention.

FIG. 4 shows an alternative embodiment of a device according to the invention. This embodiment repeats the same structure as that described above. Thus there is again a moving branch 6' which faces a fixed branch 4' and is joined by a linking region 8'. The fixed branch 4' has a first part 10' joined to a second part 14' by a sharp angle 12'. The first part 10' of the fixed branch 4' also has two openings separated by stripping lips 18'. The moving branch 6' has a planar first part 24' joined to a curved second part 28' by a sharp angle 26'. The linking region 8' also has two points of inflection 32'. The general shape of these various parts is the same as that described with reference to FIGS. 1 to 3.

In the resilient device of FIG. 4, the moving branch 6' and the fixed branch 4' are slightly further apart than in the first embodiment. There is then a moving resilient core 34' in the space between the two curved parts 14' and 28'. This core 34' takes some of the stresses during deformation of the resilient device according to the invention and makes it possible to maintain a certain distance between the moving branch 6' and the fixed branch 4'.

Figure 5:
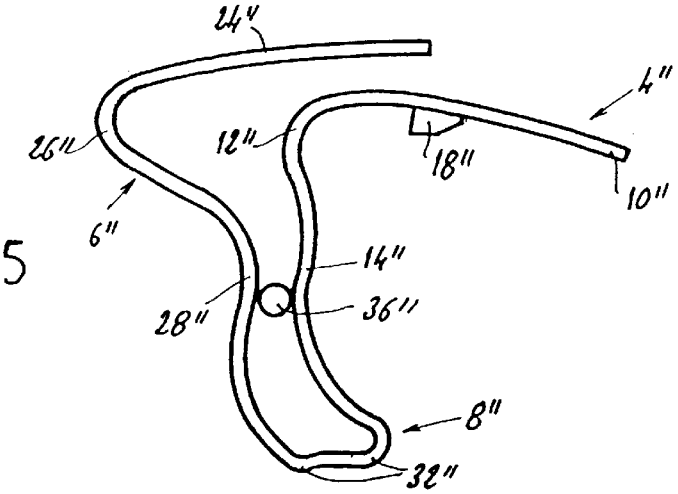

In FIG. 5, the same elements as in FIG. 4 are found again. The same reference numbers are therefore used, but with ". The moving core 34' if is replaced here by a fixed core 36" . The convex faces of the curved parts 14" and 28" then roll on this fixed core 36", which has an outer shell in the form of a circular cylinder. The moving branch 6" and the linking region 8" thus pivot about this fixed core 36"

The devices described above make it possible to limit very substantially the stresses during deformation, especially in the linking region. These devices exhibit great rigidity and the stresses to which they are subjected are relatively low.

Furthermore, the size of these devices is reduced. This makes it possible to achieve significant space savings.

The shape of the devices illustrated in the drawing makes it possible to exert on the conductor, by pinching or by retention in a slit, a larger tensile force than with the devices known from the prior art. This guarantees good electrical connection.

Once contact has been made, the stiffness of the device is increased compared with a spring of the prior art. With such a movement, it is therefore possible to exert a larger force than with a device of the prior art. This also makes it possible to save space.

Finally, by virtue of the shape given to the resilient device and especially by virtue of the pivoting of the linking region, the travel of a tool, for example a screwdriver blade, is geared down, thus making it possible to have a greater travel at the free end of the moving branch.

As it goes without saying, the invention is not limited to the preferred embodiments described above by way of nonlimiting examples; on the contrary, it encompasses any variant thereof which falls within the scope of the claims appended hereto.

Thus, for example, the resilient devices described above are applied to insulation-displacement connections. Similar devices could also be used for making a connection by pinching. In this case, it is unnecessary to provide stripping lips on the fixed part of the resilient device. It is even possible to omit the entire first part of the fixed branch. There may then be, as in document FR 2,753,840, a current supply rail against which the fixed branch of the resilient device bears and which passes through the opening made in the moving branch of this resilient device.

The "bone head" shape of the linking region may be modified. This shape makes it possible to obtain very great rigidity and to limit the stresses in this region.

The devices illustrated in the drawing are made from a metal blade of rectangular cross section. Another section could be chosen. As. seen in FIG. 6, and blade used could thus have, on each of its longitudinal edges, an excrescence. Its cross section would then have a shape reminiscent of a bone. This shape allows good distribution of the stresses in the material.

What is claimed is:

1. A resilient device allowing an electrical connection to be made in a connection terminal for electrical conductors, the device comprising a resilient material having a fixed branch intended to bear against a first part of a connection terminal, a sharp angle forming a bend in a moving branch having, on one end, an approximately planar part provided with an opening intended for passage of the end of a cable to be connected and a part facing the fixed branch, and a linking region which joins the two branches so as to form a loop, characterized in that each branch has a part which is concave toward the outside of the loop, and in that the two concave parts are approximately facing each other and form a narrow section inside the loop and wherein the linking region itself has a part which is concave toward the outside of the loop.

2. The device as claimed in claim 1, wherein the narrow section inside the loop has a dimension of one millimeter.

3. The device as claimed in claim 1, which is made from a metal blade which is thicker at its longitudinal edges than at its center.

4. The device as claimed in claim 1, wherein a fixed core is provided in the narrow section of the loop.

5. The device as claimed in claim 1, wherein a moving core is provided in the narrow section of the loop.

6. The device as claimed in claim 1, wherein the fixed branch is also sharply angled and wherein its part lying on the side of its one end is a planar part approximately parallel to the free end part of the moving branch and having an opening intended for passage of the end of an electrical cable.

7. The device as claimed in claim 6, wherein stripping lips are provided in the opening made in the fixed sharply-angled branch.

8. A connection device allowing an electrical cable to be connected, which is provided with at least one resilient device as claimed in claim 1.

9. The connection device as claimed in claim 8, which is an insulation-displacement device.

* * * * *

UNITED STATES PATENT AND TRADEMARK OFFICE

CERTIFICATE OF CORRECTION

PATENT NO. : 6,183,288 B1
DATED : February 6, 2001
INVENTOR(S) : Barrat et al.

It is certified that error appears in the above-identified patent and that said Letters Patent is hereby corrected as shown below:

Column 5,
Line 25, after "36´´" add -- . --.

Figure 6:
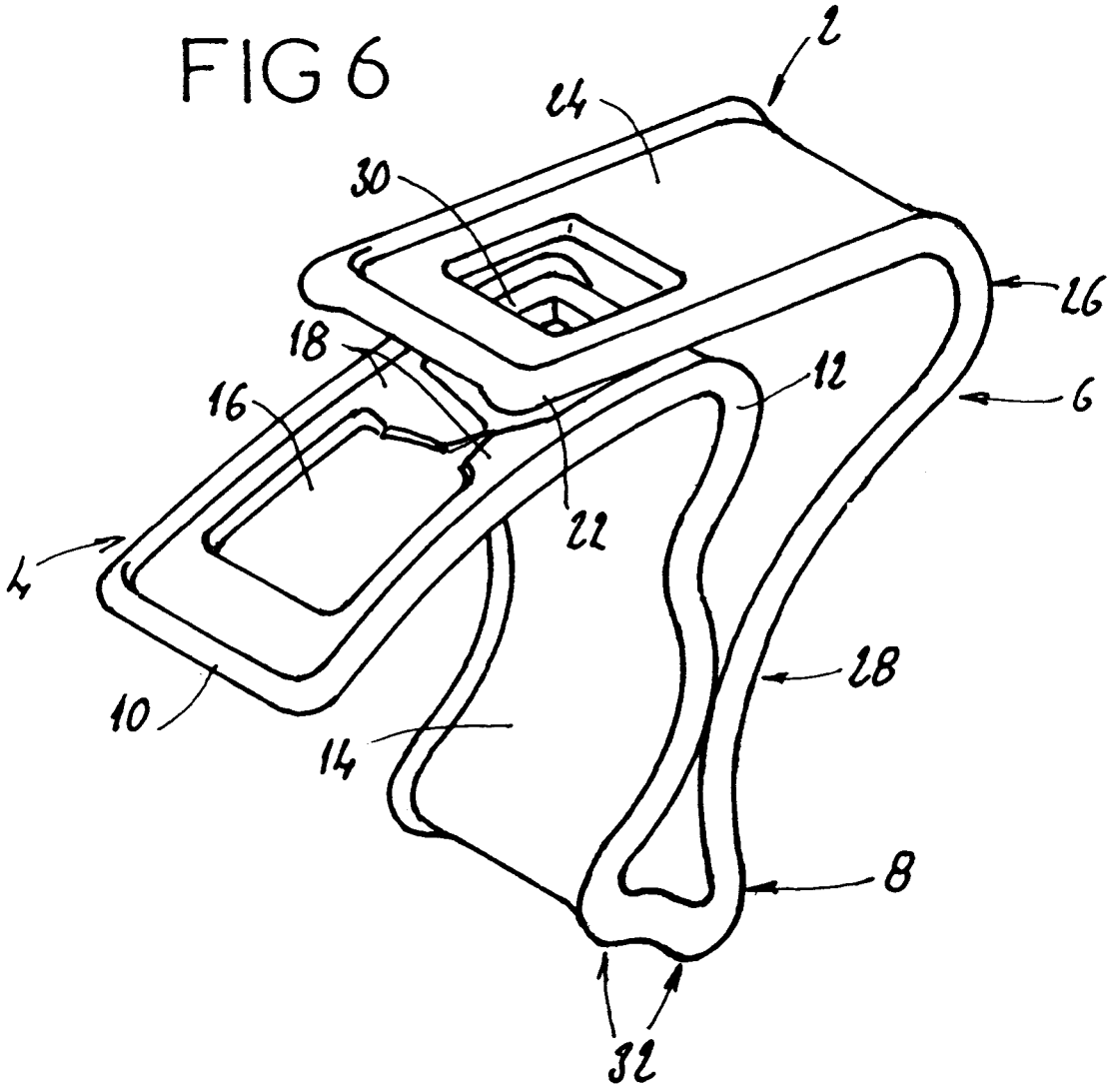
FIG. 6 is a perspective view of another embodiment of a resilient device according to the invention, wherein the blade has on each of its longitudinal edges an excrescence.

Column 6,
Line 12, delete "As. seen in FIG. 6, and blade" and insert -- The blade --.

Signed and Sealed this

Sixth Day of November, 2001

*Attest:*

Nicholas P. Godici

NICHOLAS P. GODICI
*Acting Director of the United States Patent and Trademark Office*

*Attesting Officer*